US005604511A

United States Patent [19]

Ohi

[11] Patent Number: 5,604,511

[45] Date of Patent: Feb. 18, 1997

[54] ACTIVE MATRIX LIQUID CRYSTAL DISPLAY APPARATUS

[75] Inventor: Susumu Ohi, Tokyo, Japan

[73] Assignee: NEC Corporation, Tokyo, Japan

[21] Appl. No.: 533,863

[22] Filed: Sep. 26, 1995

Related U.S. Application Data

[63] Continuation of Ser. No. 225,794, Apr. 11, 1994, abandoned.

[30] Foreign Application Priority Data

Apr. 9, 1993 [JP] Japan ..... 5-83187

[51] Int. Cl.[6] ..... G09G 5/04

[52] U.S. Cl. ..... 345/98; 345/88; 348/674

[58] Field of Search ..... 345/88, 96, 89, 345/90, 92, 94, 103, 98, 100, 204, 206, 209; 348/790–793, 674–677; 358/519, 518; 359/55; 341/122, 123; H04N 5/202

[56] References Cited

U.S. PATENT DOCUMENTS

| | | | |
|---|---|---|---|
| 4,763,026 | 8/1988 | Tsen et al. | 307/353 |
| 4,776,676 | 10/1988 | Inoue et al. | 345/97 |
| 4,825,203 | 4/1989 | Takeda et al. | 345/88 |
| 4,845,473 | 7/1989 | Matsuhashi et al. | 345/94 |
| 4,908,609 | 3/1990 | Stroomer | 345/88 |
| 5,077,784 | 12/1991 | Fujita et al. | 348/14 |
| 5,170,158 | 12/1992 | Shinya | 345/204 |

FOREIGN PATENT DOCUMENTS

| | | | |
|---|---|---|---|
| 5035199 | 2/1993 | Japan | 345/88 |

OTHER PUBLICATIONS

Okada et al., "Development of a Low Voltage Source Driver for Large TFT–LCD System for Computer Applications", 1991 IEEE, pp. 111–114.

H. Kanno et al., "A Driver LSI For Color TFT–LCD", Technical Report of IEICE, EID92–116, ED92–149, Feb. 1993, pp. 15–20 with English–language Abstract.

*Primary Examiner*—Richard Hjerpe
*Assistant Examiner*—Lun-Yi Lao
*Attorney, Agent, or Firm*—Sughrue, Mion, Zinn, Macpeak & Seas

[57] ABSTRACT

An active matrix liquid crystal display apparatus comprises a liquid crystal panel having a plurality of pixel electrodes, a vertical driver circuit and upper and lower horizontal driver circuits for driving the liquid crystal panel. A sample hold circuit receives a video signal for level-shifting, amplifying and holding the received video signal and outputs a reduced frequency signal, and a gamma conversion circuit receives an output of the sample hold circuit for gamma-converting the received signal. A data inverting circuit receives an output of the gamma conversion circuit for selectively generating a data signal inverted in comparison with a predetermined constant voltage and a non-inverted data signal. A controller controls vertical driver circuit, the upper and lower horizontal driver circuits, the sample hold circuit, the gamma conversion circuit and the data inverting circuit. The data signals in the same phase or in an opposite phase are supplied to the upper and lower horizontal driver circuits, respectively.

8 Claims, 8 Drawing Sheets

ACTIVE MATRIX LIQUID CRYSTAL DISPLAY APPARATUS

This is a Continuation of application Ser. No. 08/225,794 filed Apr. 11, 1994, now abandoned.

BACKGROUND OF THE INVENTION

1. Field of the Invention

The present invention relates to a liquid crystal display apparatus, and more specifically to an active matrix liquid crystal display apparatus configured to control a number of pixel electrodes in a liquid crystal display panel on the basis of a RGB signal (a red signal, a green signal and a blue signal which constitute a trichromatic signal).

2. Description of Related Art

A conventional active matrix liquid crystal display apparatus has been constructed to receive a red signal, a green signal and a blue signal and to drive analog or digital driver circuits for the purpose of controlling the pixel electrodes in a liquid crystal display panel.

Referring to FIG. 1, there is shown a block diagram illustrating one example of a conventional active matrix liquid crystal display apparatus. The shown conventional active matrix liquid crystal display apparatus includes an A/D converter (analog-to-digital converter) 18 receiving a red signal R, a green signal G and a blue signal B for converting them into digital signals N11, and a controller 4A receiving a horizontal synchronizing signal HS and a vertical synchronizing signal VS for controlling various parts of the active matrix liquid crystal display apparatus. The controller 4A includes therein a gamma (γ) conversion circuit 2 receiving the digital signals N11 for generating output signals N12.

The active matrix liquid crystal display apparatus also includes a D/A converter (digital-to-analog converter) 19 for converting into analog signals N13 the output signals N12 obtained by converting the output signals N11 of the D/A converter 18 by the gamma (γ) conversion circuit 2, a data inverting circuit 3 receiving the analog signals N13 for generating complementary data signals N14 and N15, and a low-pass filter (LPF) 5 and a voltage controller oscillator (VCO) 6 associated to the controller 4A.

An LCD (liquid crystal display) panel 9 includes a number of pixel electrodes 13 located in the form of a matrix. In FIG. 1, only two pixel electrodes are shown for simplification of the drawing. This LCD panel 9 is associated with an upper side horizontal driver circuit 11 and a lower side horizontal driver circuit 12 which are driven by the complementary data signals N14 and N15 outputted from the data inverting circuit 3 through signal buses 7 and 8, respectively, for the purpose of controlling a potential in a horizontal direction of the LCD panel 9. The LCD panel 9 is also associated with a vertical driver circuit 10 controlled by the controller 4A for controlling a potential in a vertical direction of the LCD panel 9.

In the above mentioned circuit, the ted signal R, the green signal G and the blue signal B are converted by the A/D converter 18 into the digital signals N11, which are in turn gamma-converted into the digital signals N12 by use of a ROM (read only memory) which is provided within the gamma (γ) conversion circuit 2 and which stores a brightness-voltage characteristics of the LCD panel 9 and input-output conversion codes necessary for demodulating a video signal (which has been raised to 0.45 power). Then, the gamma-converted digital signals N12 are returned to the analog signals N13 by the D/A converter 19, and the analog signals N13 are sign-converted so that the complementary analog signals N14 and N15 are generated. These complementary analog signals N14 and N15 are supplied to the upper side horizontal driver circuit 11 and the lower side horizontal driver circuit 12 (both of the analog type horizontal driver) which are provided at an upper side and at a lower side of the LCD panel 9. The above apparatus is an analog type active matrix liquid crystal display apparatus.

The above mentioned conventional analog type active matrix liquid crystal display apparatus requires six or eight bits or more for each output signal of the A/D converter, because of recent inclination of a full color display of the liquid crystal display. In addition, because of an increased number of pixels in the LCD panel, the dot clock of the video signal is apt to be increased. For example, in the LCD panel on the order of 1,300,000 pixels, the A/D converter requires a sampling rate of 100 MHz or more. In the A/D converter having the bit precision on the order of 8 bits and the sampling rate of 100 MHz or more, a power consumption is as large as 0.5 W to 1 W. Furthermore, the size of an overall apparatus becomes large, and the cost correspondingly becomes high. Accordingly, the active matrix liquid crystal display apparatus using the A/D converter is disadvantageous in that a low power consumption (that is a merit of the LCD panel) cannot be effectively exerted, and the whole of the apparatus is large in size and expensive.

In the above mentioned conventional analog type active matrix liquid crystal display apparatus, furthermore, the D/A converter used after the gamma conversion are also required to have a high bit precision and the high speed operation, similarly to the A/D converter used before the gamma conversion. This further increases the power consumption and makes the whole of the apparatus large in size and expensive.

Now, referring to FIG. 2, there is shown a conventional digital type active matrix liquid crystal display apparatus. The shown digital type active matrix liquid crystal display apparatus includes an A/D converter 18 receiving a red signal R, a green signal G and a blue signal B for converting them into digital data signals N11A and N11B, and an upper side horizontal driver circuit 11A and a lower side horizontal driver circuit 12B which receive the digital data signals N11A and N11B, through signal buses 7A and 8A, respectively, and a gray scale voltage supply 20 for supplying a gray scale voltage to the upper side horizontal driver circuit 11A and the lower side horizontal driver circuit 12B, respectively, a controller 4B for controlling a LCD panel 9, a vertical driver circuit 10, the A/D converter 18 and other driver circuits, similarly to the example shown in FIG. 1, and a low-pass filter (LPF) 5 and a voltage controller oscillator (VCO) 6 associated to the controller 4B.

In the shown conventional digital type active matrix liquid crystal display apparatus, the output data signals 11A and 11B are supplied directly to the horizontal driver circuits 11A and 12A, and the gamma conversion is realized by setting the voltage from the gray scale voltage supply 20 to the horizontal driver circuits 11A and 12A.

In the conventional digital type active matrix liquid crystal display apparatus, since it has no D/A converter, the power consumption can be reduced by the amount corresponding to the D/A converter. However, considering each of colors, in the case that a serial-parallel conversion of 1:N is performed in order to meet the precision of six or eight bits or more, or in order to fulfill the operating capability of the peripheral drivers (ordinarily, on the order of 30 MHz), it is necessary to supply the gamma-converted digital signals of 6N bits to 8N bits to the peripheral drivers of the LCD panel. Therefore, a layout or arrangement of wiring conductors becomes very complicated in the conventional digital type active matrix liquid crystal display apparatus. This is a hindrance in miniaturization.

SUMMARY OF THE INVENTION

Accordingly, it is an object of the present invention to provide an active matrix liquid crystal display apparatus which has overcome the above mentioned defect of the conventional ones.

Another object of the present invention is to provide an active matrix liquid crystal display apparatus which can perform a signal processing with neither an A/D converter nor a D/A converter for the analog RGB video signal, and with a low power consumption, and which is compact in size and inexpensive.

The above and other objects of the present invention are achieved in accordance with the present invention by an active matrix liquid crystal display apparatus comprising a liquid crystal panel having a plurality of pixel electrodes, a vertical driver circuit and upper and lower horizontal driver circuits for driving the liquid crystal panel, a sample hold circuit receiving a video signal for level-shifting, amplifying and holding the received video signal, a gamma conversion circuit receiving an output of the sample hold circuit for gamma-converting the received signal, a data inverting circuit receiving an output of the gamma conversion circuit for selectively generating a signal inverted in comparison with a predetermined constant voltage and a non-inverted signal, the inverted signal and the non-inverted signal being supplied to the upper and lower horizontal driver circuits, respectively, and a controller controlling the vertical driver circuit, the upper and lower horizontal driver circuits, the sample hold circuit, the gamma conversion circuit and the data inverting circuit.

According to another aspect of the present invention, there is provided an active matrix liquid crystal display apparatus comprising a liquid crystal panel having a plurality of pixel electrodes, a vertical driver circuit and upper and lower horizontal driver circuits for driving the liquid crystal panel, a sample hold circuit receiving a video signal for level-shifting, amplifying and holding the received video signal, a gamma conversion circuit receiving an output of the sample hold circuit for gamma-converting the received signal, a data inverting circuit receiving an output of the gamma conversion circuit for generating an inverted signal in the same phase in comparison with a predetermined constant voltage or a non-inverted signal in the same phase in comparison with the predetermined constant voltage, the signal in the same phase being supplied to both of the upper and lower horizontal driver circuits, and a controller controlling the vertical driver circuit, the upper and lower horizontal driver circuits, the sample hold circuit, the gamma conversion circuit and the data inverting circuit.

The above and other objects: features and advantages of the present invention will be apparent from the following description of preferred embodiments of the invention with reference to the accompanying drawings.

DESCRIPTION OF THE PREFERRED EMBODIMENTS

Figure 1:
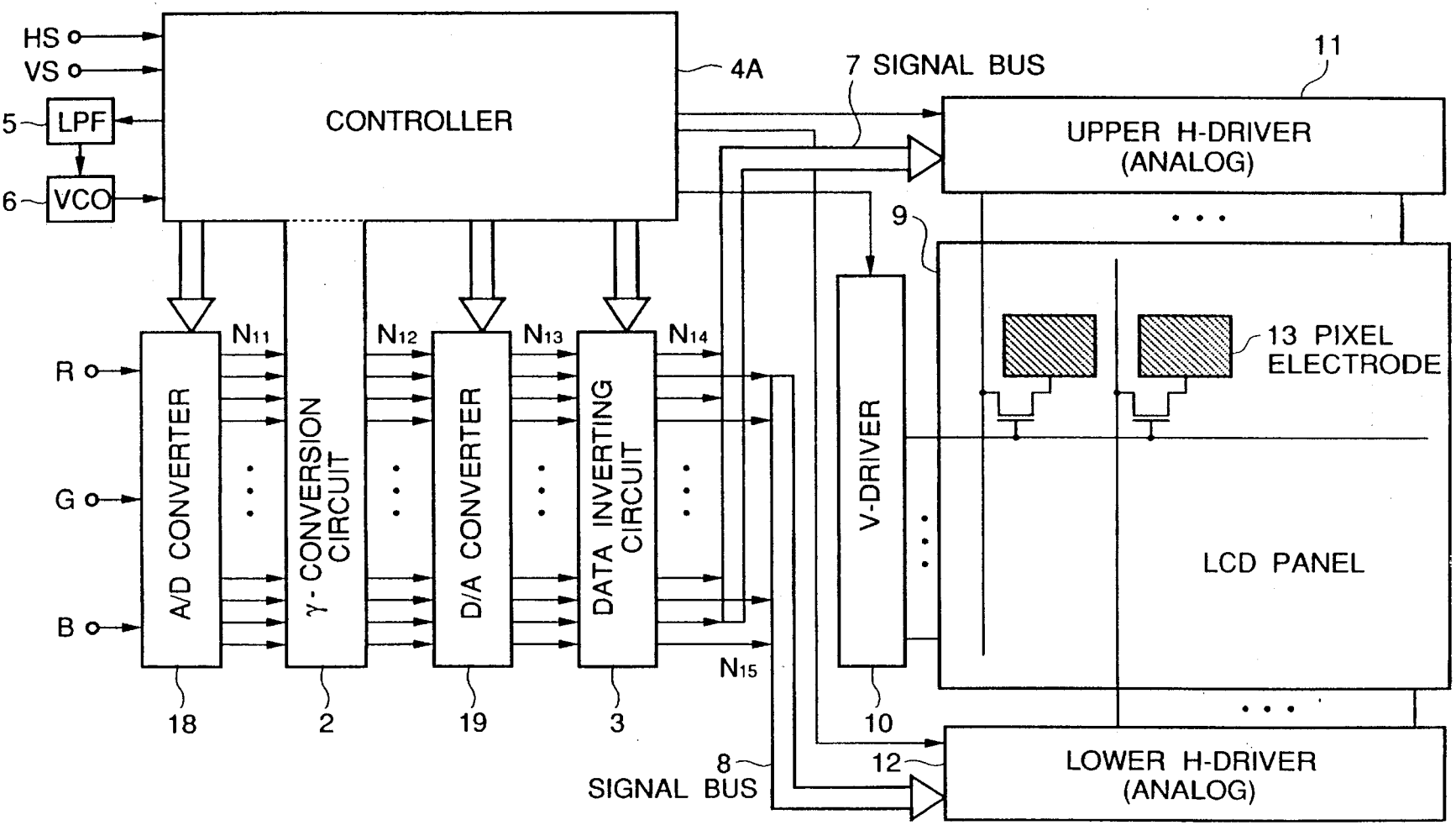
FIGURE 1 PRIOR ART
FIG. 1 is a block diagram illustrating one example of a conventional analog type active matrix liquid crystal display apparatus.
Figure 2:
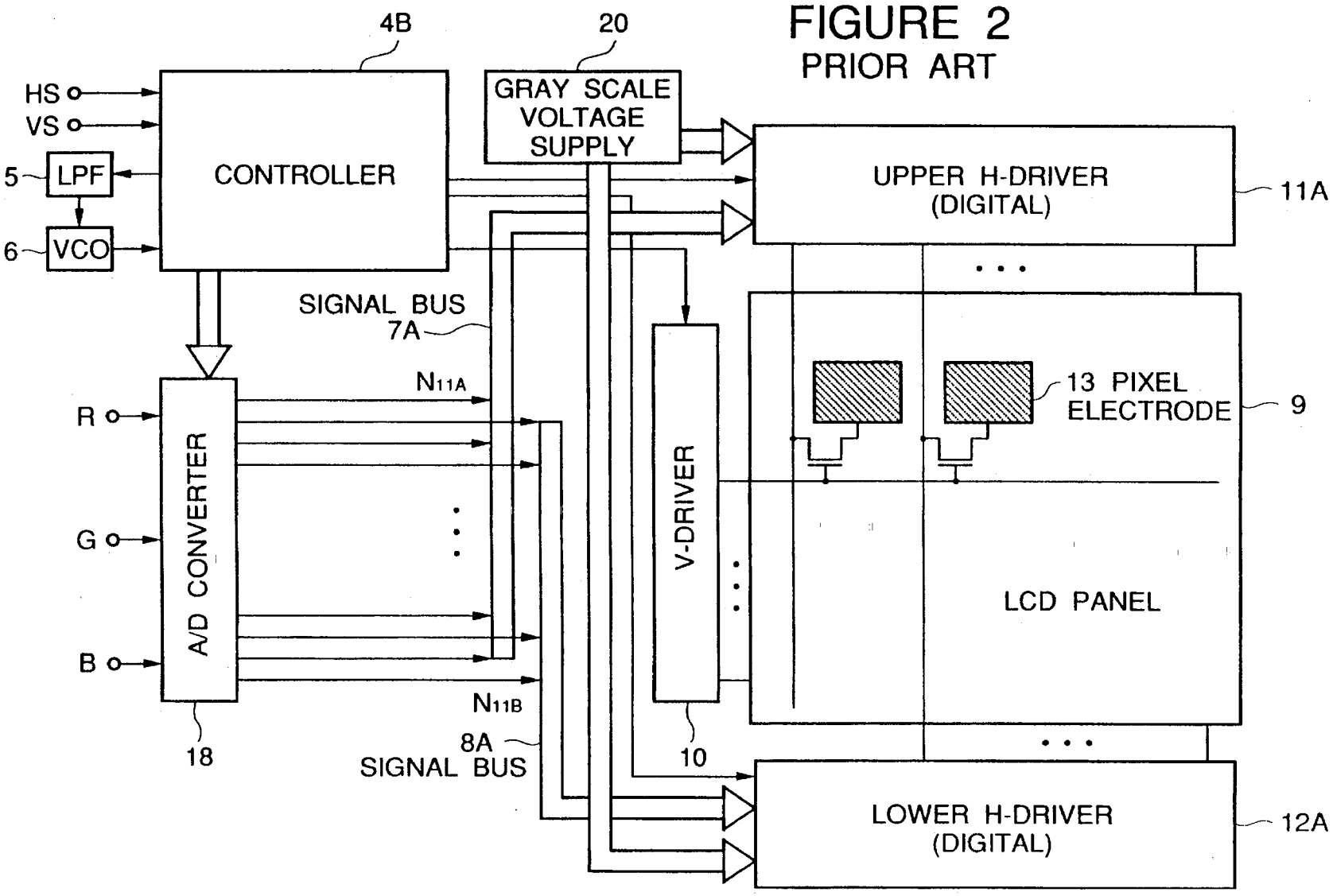
FIGURE 2 PRIOR ART
FIG. 2 is a block diagram illustrating one example of a conventional digital type active matrix liquid crystal display apparatus.
Figure 3:
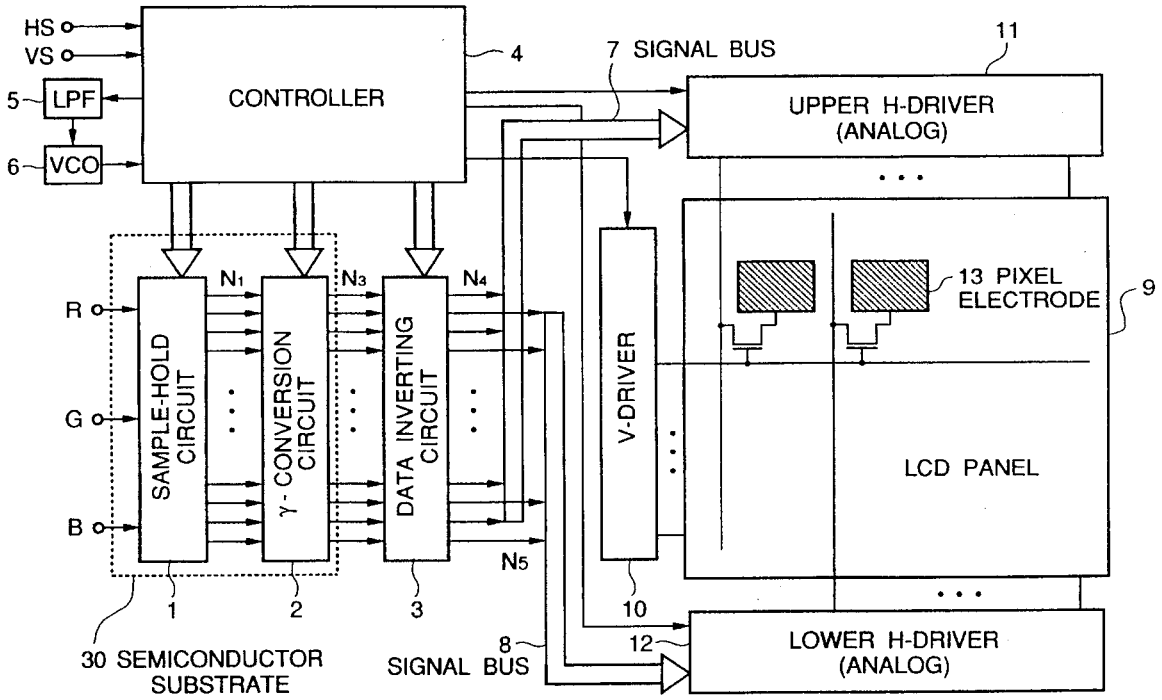
FIG. 3 is a block diagram illustrating an embodiment of the active matrix liquid crystal display apparatus in accordance with the present invention.

Referring to FIG. 3, there is shown a block diagram illustrating an embodiment of the active matrix liquid crystal display apparatus in accordance with the present invention. Similarly to the conventional example shown in FIG. 1, the embodiment shown in FIG. 3 includes an LCD panel 9 having a number of pixel electrodes 13 arranged in the form of a matrix, and a vertical driver circuit 10 and upper and lower side horizontal driver circuits 11 and 12 for driving the LCD panel 9.

Furthermore, the shown embodiment includes a sample-hold circuit 1 receiving a red signal R, a green signal G and a blue signal B for performing a level shifting, amplification and sample-holding of the received signals, a gamma (γ) conversion circuit 2 for gamma-converting output signals N1 of the sample-hold circuit 1, a data inverting circuit receiving output signals N3 of the gamma conversion circuit 2 for generating inverted signals N4 and non-inverted signals N5 complementary to each other when putting a predetermined voltage as a center reference level, and a controller 4 for controlling the above mentioned various circuits and associated with a low pass filter (LPF) 5 and a voltage controlled oscillator (VCO) 6. The signals N4 and N5 are supplied from the data inverting circuit 3 through a first signal bus 7 and a second signal bus 8 to the upper and lower side horizontal driver circuits 11 and 12 of the LCD panel 9, respectively. The sample-hold circuit 1 and the gamma conversion circuit 2 are formed together on the same semiconductor substrate 30.

Figure 4:
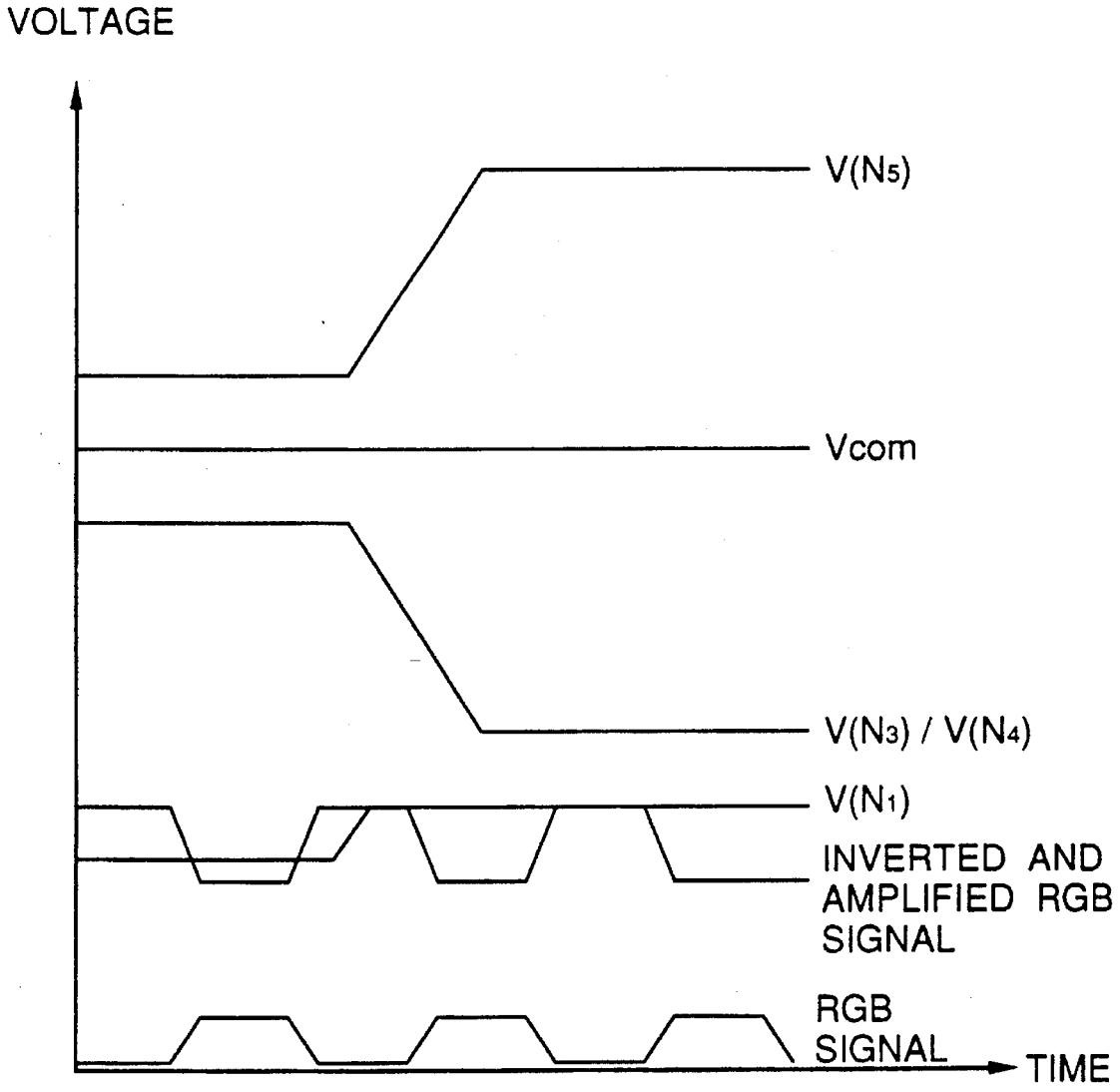
FIG. 4 is a waveform diagram illustrating a voltage on various points in the circuit shown in FIG. 3.

Now, operation of the above mentioned active matrix liquid crystal display apparatus will be described with reference to FIGS. 3 and 4. FIG. 4 is a waveform diagram illustrating a voltage on various points in the circuit shown in FIG. 3.

As shown in FIGS. 3 and 4, the RGB signal (representative of the red signal R, the green signal G and the blue signal B) is supplied to the sample-hold circuit 1, and after the RGB signal is inverted and amplified to the inverted and amplified RGB signal (FIG. 4), the inverted and amplified RGB signal is sampled and held in the sample-hold circuit 1. As a result, the RGB signal is serial-parallel converted to video signals N1. As clearly shown in FIG. 4, the video signals N1 have a frequency which is lower than the frequency of the analog RGB video signal. These serial-parallel converted video signals N1 are supplied to the gamma conversion circuit 2 in which a correction for a reverse gamma (γ) conversion at an image pick-up side (transmitter side) and compensation of the brightness-voltage characteristics of the liquid crystal are performed.

The output signals N3 of the gamma conversion circuit 2 are supplied to the data inverting circuit 3, in which, if it is possible to neglect a feed-through of a pixel voltage based on a gate voltage, a half of the gamma convened signals are inverted by using a voltage of an opposing electrode of the LCD panel 9 as a reference or base voltage, and the remaining half is supplied in a non-inverted form. Namely, the data inverting circuit 3 supplies signals: N4 and N5 having a reference or base voltage Vcom and complementary to each other with reference to the base or inversion center voltage, to the analog type upper and lower side horizontal driver circuits 11 and 12 of the LCD panel 9, respectively. These signals N4 and N5 are inverted in polarity from one line to another.

The timing of the sample-holding of the sample-hold circuit 1, the timing of the inversion of the data inverting circuit 3, and a start pulse for a shift register in each of the horizontal and vertical driver circuits 10 to 12 are controlled by corresponding signals generated in the controller 4 in synchronism with the horizontal synchronizing signal HS and the vertical synchronizing signal VS.

Figure 5:
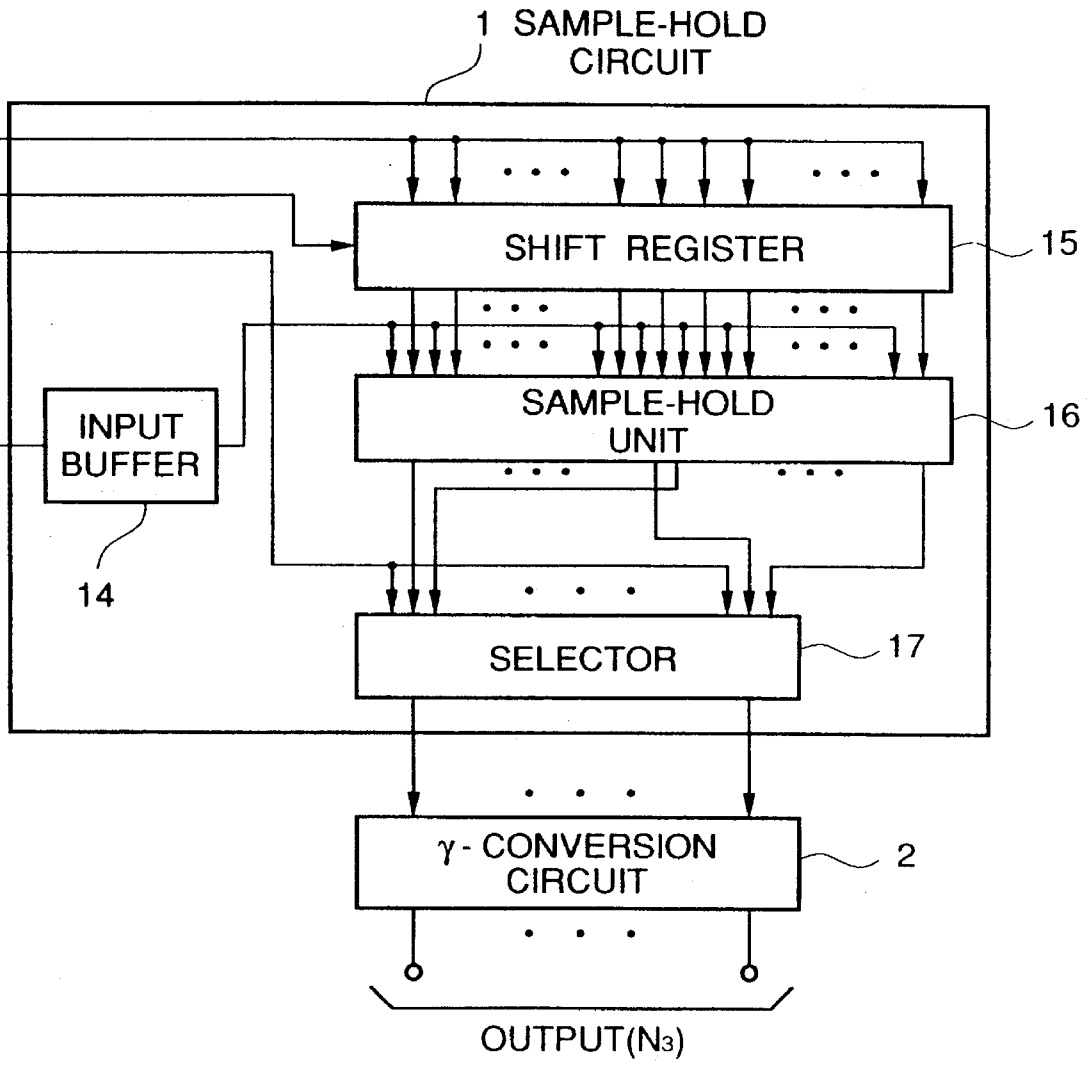
FIG. 5 is a block diagram of a sample hold circuit incorporated in the circuit shown in FIG. 3.

Referring to FIG. 5, there is shown a block diagram of the sample hold circuit 1. As shown in FIG. 5, the sample hold circuit 1 includes an input buffer 14 receiving the RGB video signal for adjusting the level of the RGB video signal, a shift register 15 receiving a clock CLK and a start pulse SP from the controller 4, a sample hold unit 16 for sampling an output of the input buffer 14 in response to parallel outputs of the shift register 15, and a selector 17 responding to a switch-over signal SE from the controller 4 selecting parallel outputs of the sample holding section 16 and for outputting the selected outputs to the gamma conversion circuit 17. FIG. 5 shows only the circuit required for one RGB signal for simplification of description, but actually, the circuit shown in FIG. 5 is required for each of the red signal R, the green signal G and the blue signal B.

In the above mentioned sample-hold circuit 1, the RGB signal supplied to the input buffer 14 is level-shifted, inverted and amplified in the input buffer 14, and then, outputted to the sample hold unit 16. On the other hand, the dot clock CLK and the start pulse SP generated in the controller 4 in synchronism with the horizontal synchronizing signal HS and the vertical synchronizing signal VS are supplied to the shift register 15, and the shift register 15 generates the sampling clocks to the sample holding section 16. The video signal inverted and amplified by the input buffer 14 is sampled and held in a corresponding stage of the sample holding section 16 in response to the sampling clock from a corresponding stage of the shift register. A first half and a second half of sample holding stages within the sample holding section 16 are paired, and the outputs of each pair of the sample holding stages are latched in a corresponding latch provided in the selector 17. In response to the switch-over signal SE from the controller 4, the selector 17 operates to output either the outputs of the first half of the sample holding section 16 or the outputs of the second half of the sample holding section 16 as the output signals N3 supplied to the gamma conversion circuit 2.

As mentioned above, the sample hold circuit 1 and the gamma conversion circuit 2 are implemented on the same semiconductor chip 30, but can be implemented on different semiconductor chips. In addition, if it is allowed from the viewpoint of the power consumption, of an LSI (large scale integrated circuit), all circuits necessary for all of the red signal R, the green signal G and the blue signal B are preferred to be implemented on the same semiconductor chip. However, if it is not allowed from the viewpoint of the power consumption, all circuits necessary for each of the red signal R, the green signal G and the blue signal B can be implemented on a discrete semiconductor chip.

Figure 6A:
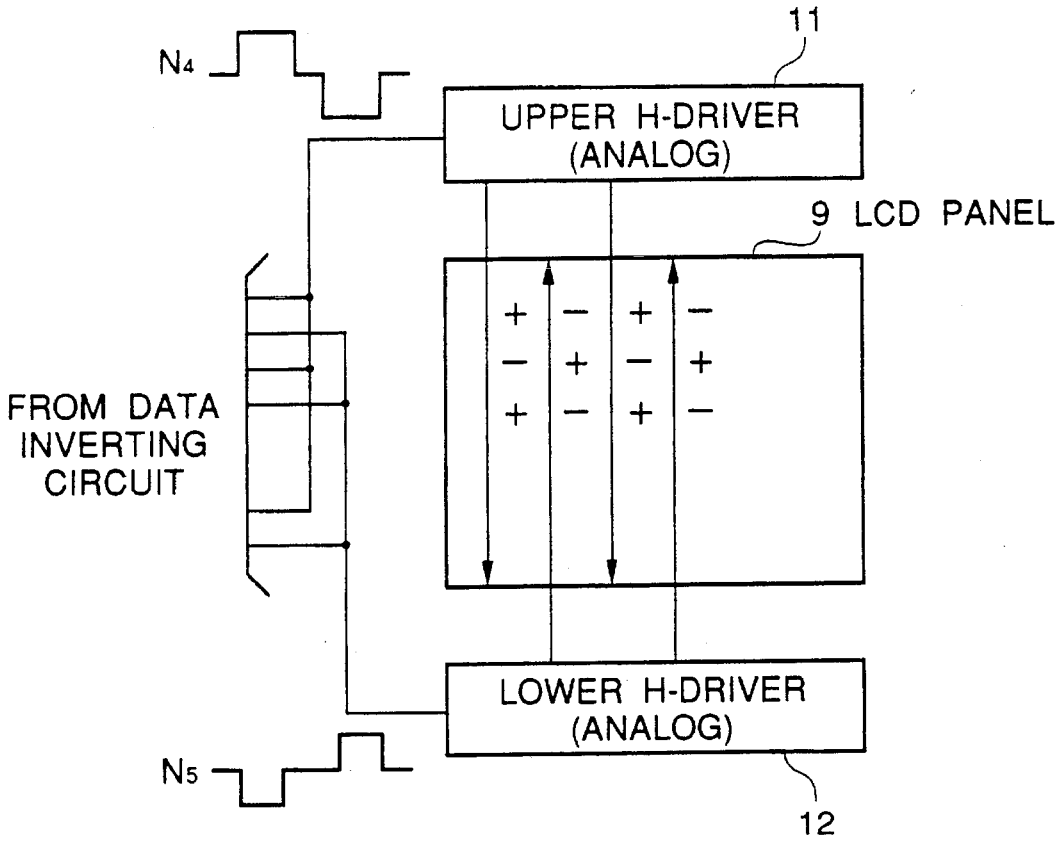
FIG. 6A illustrates a driving circuit for the LCD panel shown in FIG. 3.
Figure 6B:
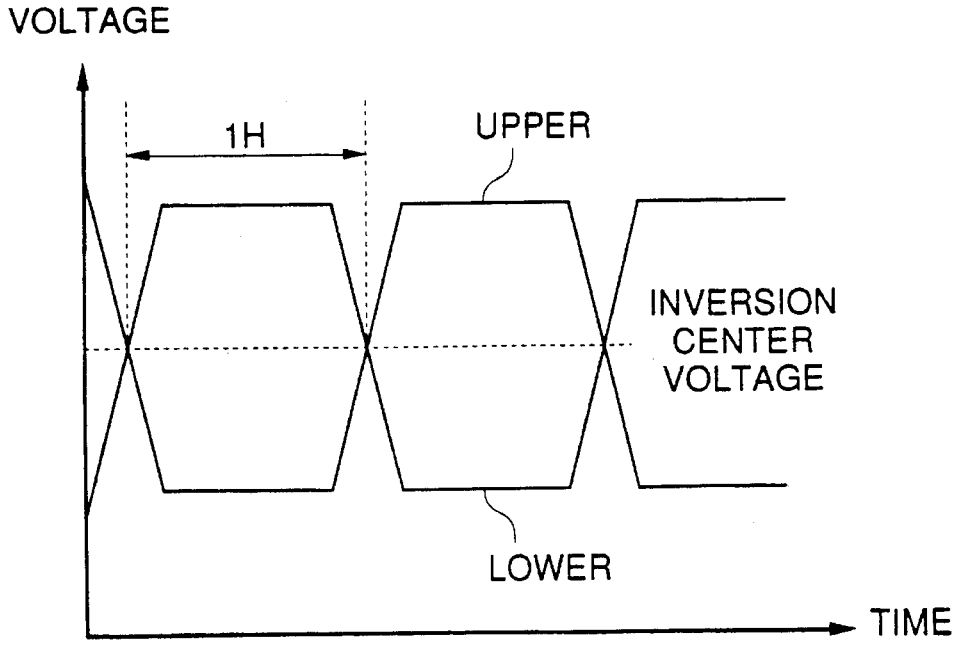
FIG. 6B is a waveform diagram illustrating a driving voltage in the driving circuit shown in FIG. 6A.

Referring to FIGS. 6A and 6B, there are shown a circuit for driving the LCD panel, and a waveform diagram of the driving voltages. As will be seen from FIGS. 6A and 6B, the shown driving system is a dot inversion driving system. The data signals N4 and N5 opposite to each other in phase centering around the reference voltage or the inversion center voltage, are supplied from the data inverting circuit 3 to the upper and lower horizontal driver circuits 11 and 12, so that the inverted signal and the non-inverted signal are alternately applied to the pixel electrodes within each one horizontal scan period. In addition, the inversion and the non-inversion are exchanged from one horizontal scan period from another. Accordingly, reviewing each pixel shown in FIG. 6A, a plus (+) indicative of the non-inversion alternates with a minus (–) indicative of the inversion in a direction (vertical direction) of data line connected to the upper and lower horizontal driver circuit, as well as in a direction (horizontal direction) of scan lines connected to the vertical driver circuit 10.

A data line inversion driving system different from the dot inversion driving system has been also known. In this data line inversion driving system, the data signals (N4 and N5) opposite to each other in phase centering around the inversion center voltage, are supplied to the upper and lower horizontal driver circuits 11 and 12, and, the inversion and the non-inversion are exchanged from one vertical scan period from another. Accordingly, if, in one vertical period, all the data lines connected to the upper side horizontal driver circuit 11 are (+) and all the data lines connected to the lower Side horizontal driver circuit 11 are (–), in a just succeeding vertical period, all the data lines connected to the upper side horizontal driver circuit 11 become (–) and all the data lines connected to the lower side horizontal driver circuit 11 become (+).

In the above mentioned first embodiment, neither an A/D converter nor a D/A converter is used for processing the analog RGB signals, and only the serial-parallel conversion and the gamma conversion are performed. Therefore, a lower power consumption can be obtained. In addition, if the sample hold circuit 1 and the gamma conversion circuit 2 are implemented in a single chip, a compact and inexpensive circuit can be obtained.

Figure 7:
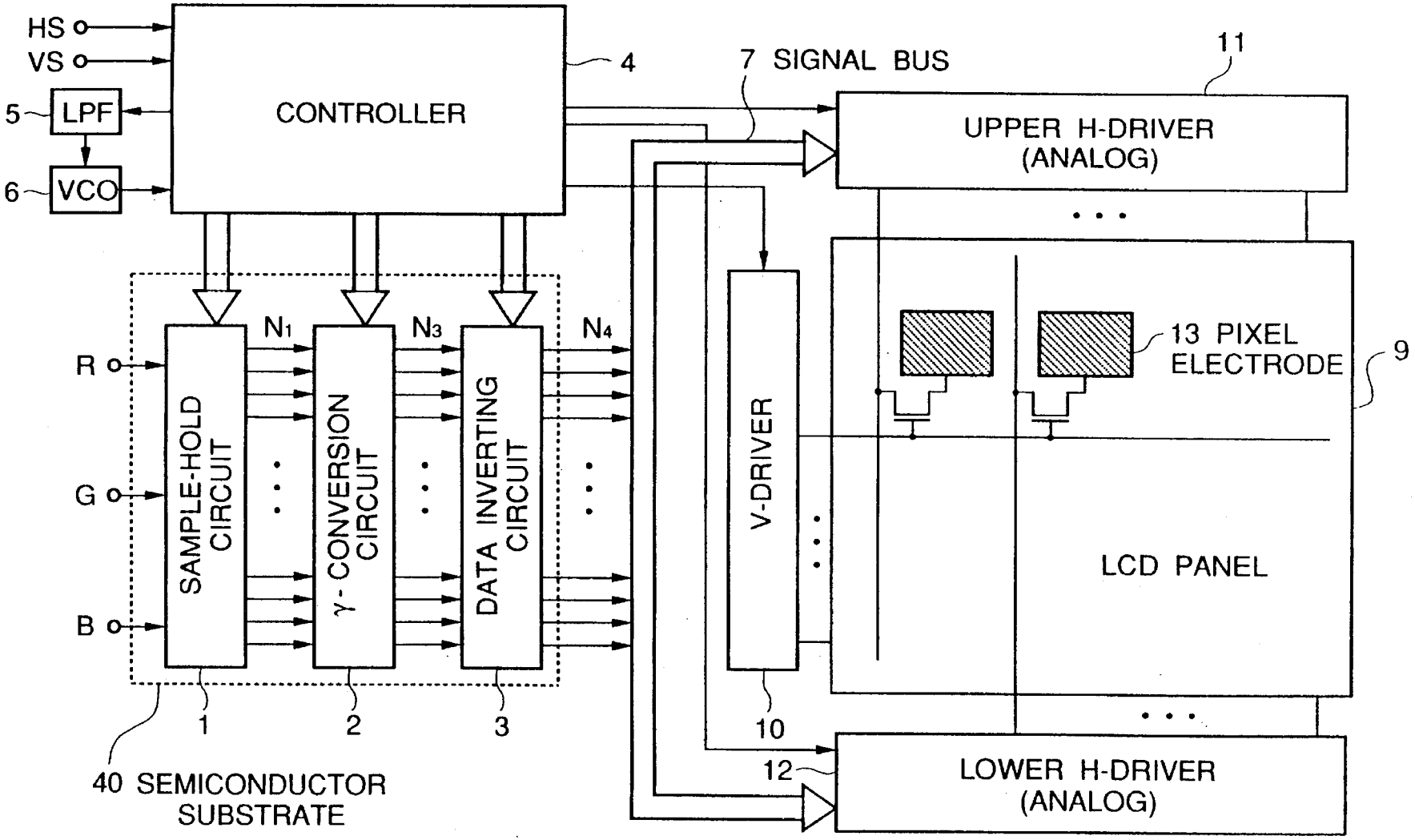
FIG. 7 is a block diagram illustrating another embodiment of the active matrix liquid crystal display apparatus in accordance with the present invention.

Referring to FIG. 7, there is shown a block diagram illustrating another embodiment of the active matrix liquid crystal display apparatus in accordance with the present invention. In FIG. 7, elements corresponding to those shown in FIG. 3 are given the same Reference Numerals or Signs.

In comparison with the first embodiment, the second embodiment is featured in that the sample hold circuit 1, the gamma conversion circuit 2 and the data inverting circuit 3 are implemented on the same semiconductor substrate 40, and the data signals are supplied from the data inverting circuit 3 through only the same signal bus 7 to both the upper and lower horizontal driver circuits 11 and 12. In the other structure, the second embodiment is the same as the first embodiment, and therefore, a detailed description thereof will be omitted for simplification of explanation.

Figure 8A:
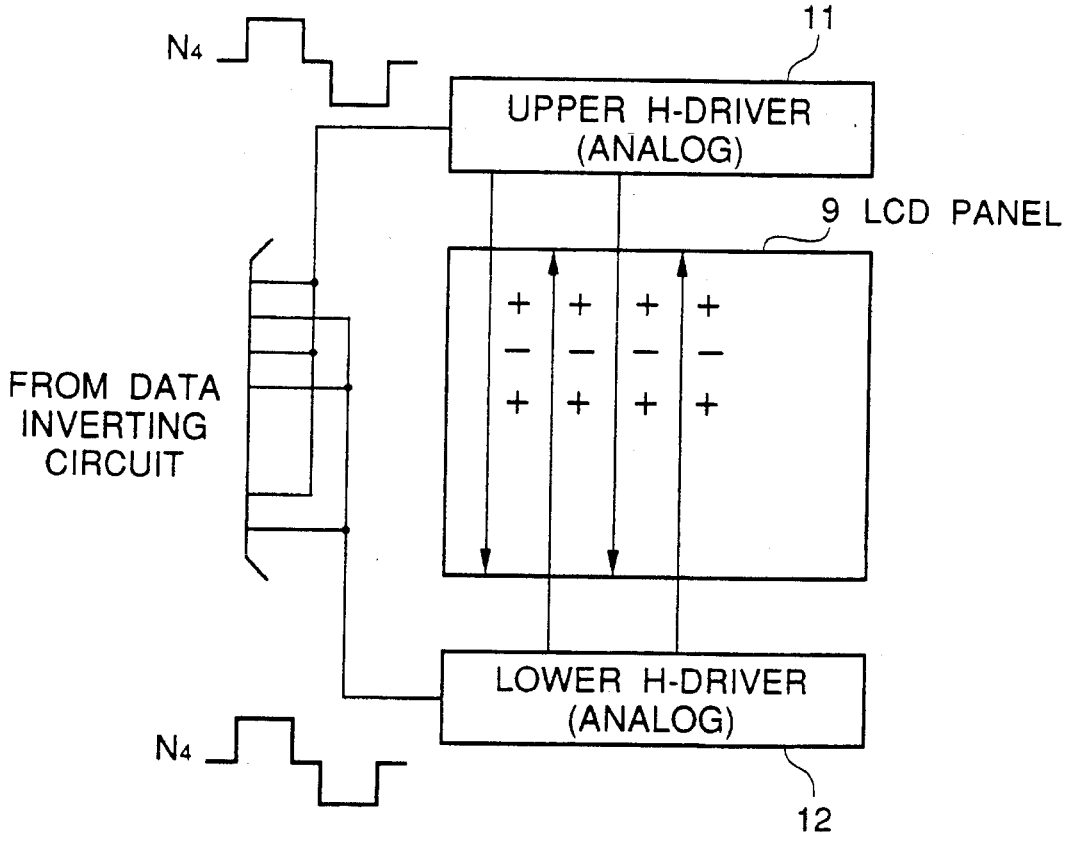
FIG. 8A illustrates a driving circuit for the LCD panel shown in FIG. 7.
Figure 8B:
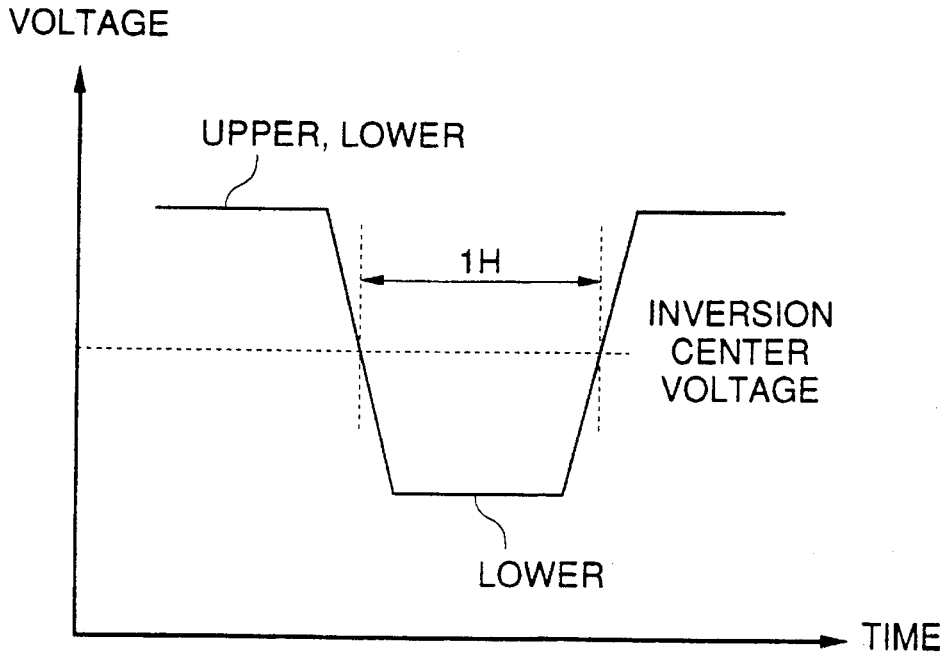
FIG. 8B is a waveform diagram illustrating a driving voltage in the driving circuit shown in FIG. 7A.

FIG. 8A illustrates a driving circuit for the LCD panel shown in FIG. 7, and FIG. 8B is a waveform diagram illustrating a driving voltage in the driving circuit shown in FIG. 7A. As could been seen from FIGS. 8A and 8B, this driving system is a gate line inversion driving system. In this gate line inversion driving system, the data signals N4 in the same phase in comparison with an inversion center voltage, are supplied to both he upper and lower horizontal driver circuits 11 and 12, but, the inversion and the non-inversion alternate from one horizontal scan period from another. Accordingly, the polarities of the voltages written to the pixel electrodes are the same in the same scan line driven by the vertical driver circuit 10, and the polarities of the write voltages alternate from one horizontal line to another.

A frame inversion driving system different from the gate line inversion driving system has been also known. In this case, the data signals (N4) in the same phase in comparison with an inversion center voltage, are supplied to both the upper and lower horizontal driver circuits 11 and 12, but, the inversion and the non-inversion alternate from one vertical scan period from another. Accordingly, if all the polarities of the voltages written to all the pixel electrodes are plus (+) in one frame, all the polarities of the voltages written to all the pixel electrodes become minus (–) in a just succeeding frame.

In the just above mentioned second embodiment, since the serial-parallel conversion and the gamma conversion are performed with using neither an A/D converter nor a D/A converter for processing the analog RGB signals, a lower power consumption can be obtained. In addition, since the sample hold circuit 1, the gamma conversion circuit 2 and the data inverting circuit 3 are implemented in a single chip, a compact and inexpensive circuit can be obtained.

The invention has thus been shown and described with reference to the specific embodiments. However, it should be noted that the present invention is in no way limited to the details of the illustrated structures but changes and modifications may be made within the scope of the appended claims.

I claim:

1. A full color active matrix liquid crystal display apparatus comprising:

a liquid crystal panel having a plurality of pixel electrodes, a vertical driver circuit and upper and lower horizontal driver circuits for driving the liquid crystal panel, a sample and hold circuit receiving an analog RGB video signal for level-shifting, amplifying and holding the received video signal, and for outputting the held signals having a reduced frequency as parallel signals, a gamma conversion circuit, directly connected to the sample and hold circuit, for receiving said parallel signals having said reduced frequency for gamma-converting the received parallel signals, a data inverting circuit receiving the gamma-converted parallel signals output from said gamma conversion circuit for selectively generating a signal inverted in comparison with a predetermined constant voltage and a non-inverted signal, said inverted signal and said non-inverted signal being supplied to said upper and lower horizontal driver circuits, respectively, and a controller controlling said vertical driver circuit, said upper and lower horizontal driver circuits, said sample and hold circuit, said gamma conversion circuit and said data inverting circuit, said sample and hold circuit includes an input buffer for level-shifting and amplifying said video signal, a sample holding unit for sampling and holding the amplified video signal, a shift register, responding to a first signal from an external source, for generating a signal determining a sampling timing of said sample holding unit to said sample holding unit, and a selector receiving the signals sample-held in said sample holding unit for outputting to said gamma conversion circuit ones of the sample-held signals, selected in accordance with a second signal from an external source.

2. An active matrix liquid crystal display apparatus claimed in claim 1 wherein said inverted signal and said non-inverted signal are inverted in said data inverting circuit tinder control of said controller from one horizontal scan period to an other.

3. An active matrix liquid crystal display apparatus claimed in claim 1 wherein said inverted signal and said non-inverted signal are inverted in said data inverting circuit under control of said controller from one vertical scan period to another.

4. An active matrix liquid crystal display apparatus claimed in claim 1 wherein said sample hold circuit and said gamma conversion circuit are implemented on the same semiconductor substrate.

5. A full color active matrix liquid crystal display apparatus comprising:

a liquid crystal panel having a plurality of pixel electrodes, a vertical driver circuit and upper and lower horizontal driver circuits for driving the liquid crystal panel, a sample and hold circuit receiving an analog RGB video signal for level-shifting, amplifying and holding the received video signal and for outputting the held signals having a reduced frequency as parallel signals, a gamma conversion circuit, directly connected to said sample and hold circuit, for receiving said parallel signals having a reduced frequency for gamma-converting the received parallel signals, a data inverting circuit receiving the gamma-converted parallel signals output from said gamma conversion circuit for generating an inverted signal in the same phase in comparison with a predetermined constant voltage or a non-inverted signal in the same phase in comparison with said predetermined constant voltage, said signal in the same phase being supplied to both of said upper and lower horizontal driver circuits, and a controller controlling said vertical driver circuit, said upper and lower horizontal driver circuits, said sample and hold circuit, said gamma conversion circuit and said data inverting circuit, said sample and hold circuit includes an input buffer for level-shifting and amplifying said video signal, a sample holding unit for sampling and holding the amplified video signal, a shift register, responding to a first signal from an external source, for generating a signal determining a sampling timing of said sample holding unit to said sample holding unit, and a selector receiving the signals sample-held in said sample holding unit for outputting to said gamma conversion circuit ones of the sample-held signals selected in accordance with a second signal from an external source.

6. An active matrix liquid crystal display apparatus claimed in claim 5 wherein said inverted signal and said non-inverted signal are inverted in said data inverting circuit under control of said controller from one horizontal scan period to another.

7. An active matrix liquid crystal display apparatus claimed in claim 5 wherein said inverted signal and said non-inverted signal are inverted in said data inverting circuit under control of said controller from one vertical scan period to another.

8. An active matrix liquid crystal display apparatus claimed in claim 5 wherein said sample hold circuit, said gamma conversion circuit and said data inverting circuit are implemented on the same semiconductor substrate.

* * * * *